United States Patent [19]

Buckley

[11] Patent Number: 4,915,330

[45] Date of Patent: Apr. 10, 1990

[54] APPARATUS FOR HOLDING A BAG

[76] Inventor: Paul B. Buckley, Suite #3- 444 West 12th Avenue, Vancouver, British Columbia, Canada, V5Y 1V3

[21] Appl. No.: 213,887

[22] Filed: Jun. 30, 1988

[51] Int. Cl.[4] ..... B65B 67/04

[52] U.S. Cl. ..... 248/99; 248/300; 248/302; 248/223.4

[58] Field of Search ..... 248/100, 99, 95, 101, 248/300, 302, 316.8, 546, 223.4; 220/1 T, 18, 85 H

[56] References Cited

U.S. PATENT DOCUMENTS

| | | | |
|---|---|---|---|
| 247,332 | 9/1881 | Gardner | 248/99 |
| 2,305,863 | 12/1942 | Ginter | 248/100 |
| 2,995,329 | 8/1961 | Talcott, Jr. | 248/100 X |
| 3,131,251 | 4/1964 | Ryan | 248/224.1 X |
| 4,620,681 | 11/1986 | Staley, III et al. | 248/95 |
| 4,638,968 | 1/1987 | Auten | 248/100 X |
| 4,669,689 | 6/1987 | Jones | 248/152 X |
| 4,695,020 | 9/1987 | Collins | 248/100 |

FOREIGN PATENT DOCUMENTS

| | | | |
|---|---|---|---|
| 1100926 | 5/1981 | Canada | 248/12 |
| 1262956 | 2/1972 | United Kingdom | 248/99 |

*Primary Examiner*—Ramon S. Britts
*Assistant Examiner*—Karen J. Chotkowski
*Attorney, Agent, or Firm*—Bull, Housser & Tupper

[57] ABSTRACT

An apparatus for holding a bag and being securable to a surface. The apparatus includes first and second supporting devices for supporting the bag and first and second bag holders connected to the first and second supporting devices respectively. The first and second bag holders are operable to hold first and second portions of the bag. The apparatus further includes first and second resilient portions cooperating with the first and second supporting devices respectively to resiliently support the first and second portions of the bag to facilitate bending thereby accommodating bags of various sizes.

18 Claims, 6 Drawing Sheets

APPARATUS FOR HOLDING A BAG

FIELD OF THE INVENTION

The invention relates to a bag holder for holding bags in a convenient position for use, particularly as household garbage containers.

BACKGROUND OF THE INVENTION

Plastic bags such as those obtained to carry groceries when grocery shopping, are often used for a purpose other than carrying groceries when the bags reach a consumer's home. Alternative purposes may include acting as a garbage bag or acting as a container for virtually any type of goods. The use of a plastic bag as a garbage bag, for example, requires that either the bag be held open permanently or opened each time an article is placed in the bag.

To open the bag each time requires two-handed operation which is not always possible or convenient. Furthermore, because of the collapsible nature of plastic bags, the bag can be more useful if it is suspended in some way. Thus, means for holding the bag open and for supporting the bag for filling would be desirable.

To hold a plastic bag open, a device such as that described in Canadian Patent No. 1,100,926 issued to Lunde may be used. The Lunde device has outwardly protruding arms which hold a first and second handle of the bag in a rigid spaced apart position thereby holding an opening in the bag at its maximum size. A bag held in this way is susceptible to over filling which can lead to excessive weight, often ripping the handles off the bag. Over filling the bag can prevent it from being closed thereby possibly allowing articles to fall out of the bag. Furthermore, the Lunde device is fixed in size and may not be readily adjusted to hold bags of different sizes.

SUMMARY OF THE INVENTION

According to the present invention, an apparatus for holding a bag is securable to a surface. The apparatus includes first and second supporting means for supporting the bag and first and second bag holders connected to the first and second supporting means respectively. The first and second bag holders are operable to hold first and second portions of the bag. The apparatus further comprises first and second resilient portions cooperating with the first and second supporting means respectively to resiliently support the first and second portions of the bag to fascilitate bending thereby accommodating bags of various sizes.

The apparatus reduces the problems of the prior art by providing a flexible apparatus which can hold bags of various sizes. The apparatus is easily adjustable to accommodate bags of virtually any size. It can hold bags with heavy loads and absorb the shock of loading the bag with heavy objects with less change of ripping the handles off the bag. Furthermore the apparatus remains in close proximity to the surface supporting the bag and does not protrude outwardly as does the prior art.

DESCRIPTION OF THE PREFERRED EMBODIMENT

Figure 1:
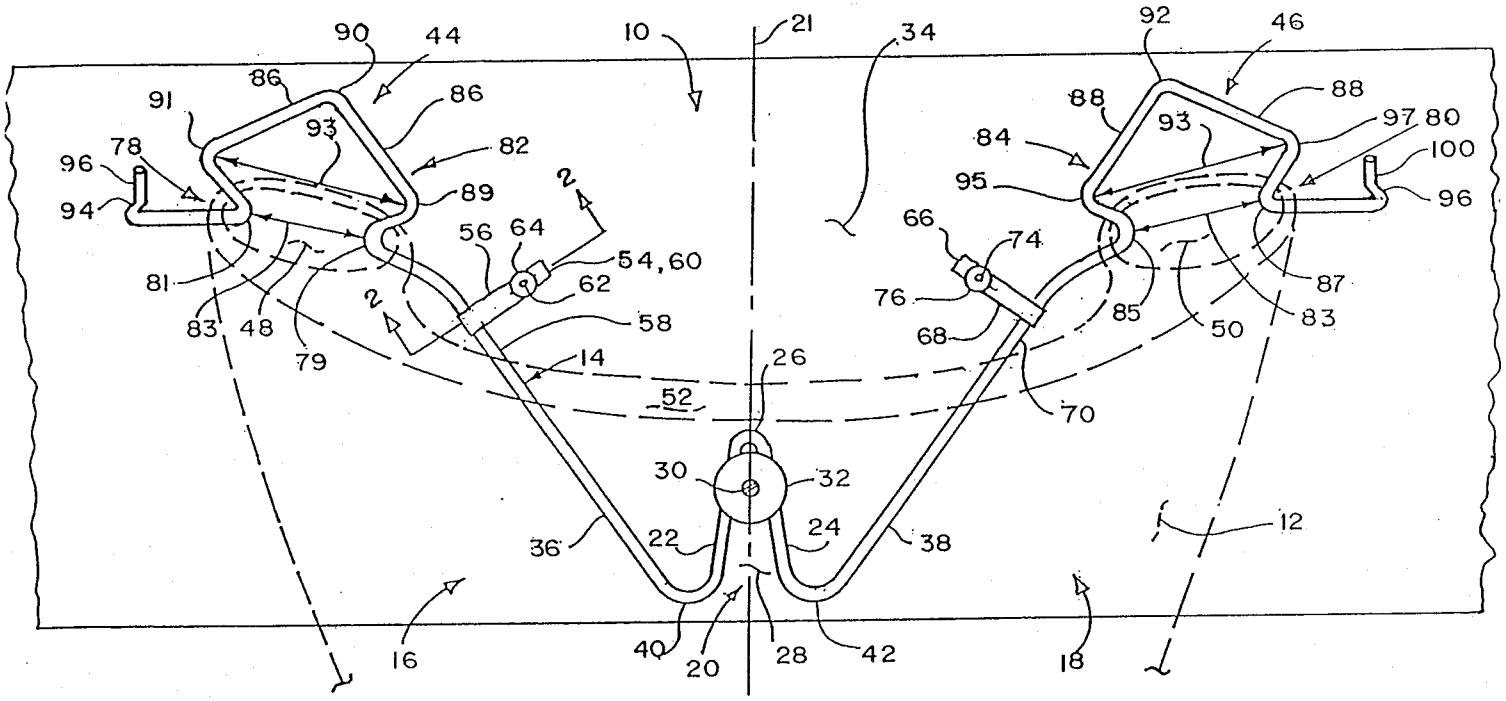
FIG. 1 is a simplified front view of an apparatus for holding a bag according to a first embodiment of the invention; the apparatus being shown secured to a vertical surface and supporting a bag.

Referring to FIG. 1 an apparatus for holding a bag is shown generally at 10, and is holding a bag illustrated at 12 in broken outline. The apparatus is made of a piece of vinyl coated wire 14 bent into a shape generally resembling a deformed "W". The vinyl coated wire provides resilient properties for the operation of the device as well as decorative and corrosion resistant properties.

The apparatus 10 comprises three main areas; a first side portion shown generaly at 16, a second side portion shown generally at 18 and a middle section shown generally at 20. The first and second side portions are mirror images of each other about a vertical axis 21 running symmetrically through the middle section 20 of the apparatus.

The middle section 20 is bent to resemble the middle of the "W" shape. The middle section has a first portion 22 connected to and spaced apart from a second portion 24 by a first bend 26. The first and second members are so disposed to form a fastening portion 28 for receiving a fastener such as a screw 30 and washer 32 to secure the apparatus to a surface 34. The fastening portion 28 provides first means for fastening the apparatus to a surface.

The first and second portions 22 and 24 are connected to third and fourth portions 36 and 38 by a second and third bend 40 and 42 respectively. The third and fourth portions are also connected to first and second bag holders shown generally at 44 and 46 respectively which are operable to hold first and second portions 48 and 50 of the bag, which portions are usually the handles of the bag. The third and fourth portions 36 and 38 provide first and second supporting means for supporting the bag.

The second and third bends 40 and 42 provide first and second resilient portions which cooperate with the first and second supporting means to resiliently support the first and second portions 48 and 50 of the bag 12. The resilient portions allow bending of the third and fourth members 36 and 38 thereby allowing the positions of the first and second bag holders 44 and 46 to be varied. The positions of the first and second bag holders are varied by a user who pulls on an outward edge of the bag. As the outward edge of the bag is pulled, it exerts a force on the first and second bag holders which tend to pull the third and fourth portions outwardly from the surface, the third and fourth portions bending about the first and second resilient portions. The resilient portions apply a force tending to return the first and second bag holders to their original positions. The resilient portions also permit the positions of the first and second bag holders to be adjusted to accommodate bags of various sizes.

Figure 2:
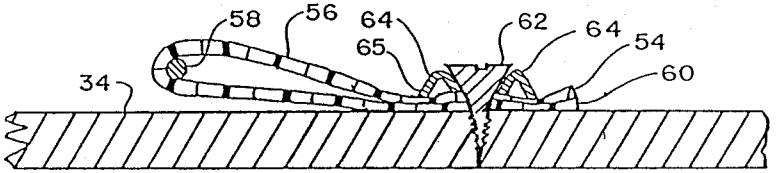
FIG. 2 is a simplified cross sectional view of the apparatus of FIG. 1 taken along line 2—2 of FIG. 1.

Referring to FIGS. 1 and 2, a first elastic link 56 is connected to an outer end 58 of the third member 36. The first elastic link has first and second end portions 54 and 60 each having a respective opening, The link is bent into a U-shape with the outer end 58 of the third member between the two end portions, the openings in each end portion being in alignment.

A second screw 62 is inserted through the openings in the end portions and is used to draw a second washer 64 to crimp the elastic link to the surface 34. Referring to FIG. 2, the second washer is a finishing washer which has a lip 65 to facilitate crimping. The use of a finishing washer of this type has been found to be particularly effective for fastening the elastic link to relatively soft surfaces such as drywall.

Referring to FIG. 1, a second elastic link 68, similar to the first elastic link 56, is connected to an outer end 70 of the fourth member 38. A third screw 74 and third washer 76 are used to connect the second elastic link to the surface 34 in a similar manner to the first elastic link. The outer end of the fourth member is thus secured to the surface. The first and second elastic cords provide second and third means for fastening the first and second supporting means respectively to the surface.

The first and second bag holders, 44 and 46, have first and second collar portions 78 and 80 respectively and have first and second retaining portions 82 and 84 respectively. The first and second collar portions 78 and 80 are formed from first and second pairs of bends respectively in the wire. The first pair of bends includes a first bend 79 and a second bend 81, the bends having edges spaced apart by a first distance 83. The second pair of bends including a first bend 85 and a second bend 87 also having edges spaced apart by the first distance 83. The first bend 79 is connected to the third portion 36 of the wire. The first bend 85 of the second pair is connected to the fourth portion 38 of the wire. The first and second collar portions engage the first and second portions 48 and 50 of the bag by providing a seat on which the handles or other openings in the first and second portions of the bag may rest.

The first and second retaining portions 82 and 84 are formed from third and fourth pairs of bends respectively in the wire. The third pair of bends includes a first bend 89 and a second bend 91, the bends having edges spaced apart by a second distance 93, the second distance being greater than the first distance 83. The fourth pair of bends also includes a first bend 95 and a second bend 97 also having edges spaced apart by the second distance 93.

The third and fourth pairs of bends forming the first and second retaining portions 82 and 84 are disposed adjacent the first and second pairs of bends forming the collar portions 78 and 80. The pairs of bends forming the retaining portions, being spaced apart by a greater distance than the pairs of bends forming the collar portions, act to prevent the first and second portions of the bag from slipping off the collar portions. This is effective when the apparatus is subject to movement.

The bends forming the retaining portions 82 and 84 are connected to first and second pairs of straight segments 86 and 88 respectively. The pairs of straight segments are joined together by fourth and fifth bends 90 and 92 respectively. The first and second pairs of straight segments and the fourth and fifth bends form first and second head portions respectively which are "arrowhead shaped" for passing easily through handle openings, or through holes in the first and second portions 48 and 50 of the bag 12.

Figure 3:
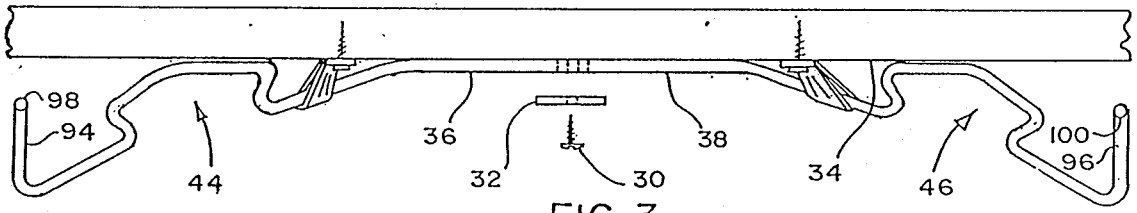
FIG. 3 is a simplified top view of the apparatus of FIG. 1, the bag being omitted.
Figure 4:
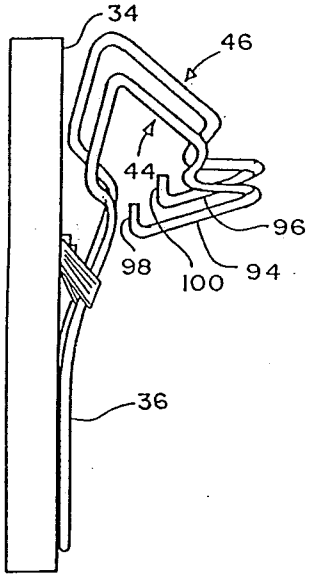
FIG. 4 is a simplified side view of the apparatus of FIG. 1.

As seen in FIGS. 1, 3 and 4, the portions 22, 24, 36, 38, and are essentially within a plane generally adjacent and parallel to the surface 34. The bag holders 44 and 46 are inclined out of the plane, so that portions adjacent the elastic cords are nearest the surface 34 as shown. Referring to FIGS. 1, 3 and 4, fifth and sixth portions 94 and 96 are connected to the first and second bag holders 44 and 46 respectively. The fifth and sixth portions are bent out of the respective planes of their corresponding bag holders 44 and 46 in a direction toward the surface 34 when the apparatus is secured thereto.

First and second hook portions 98 and 100 are bent parallel to the surface 34 and upwardly from the fifth and sixth portions respectively and may be used to pierce holes in a bag otherwise having no holes, thereby rendering it useable with the apparatus. The hook portions can also act as hooks to allow articles such as air freshners, etc. to be suspended therefrom. The hook portions 98 and 100, in conjunction with the fifth and sixth projections 94 and 96, form first and second stoppers for preventing the apparatus and bag mounted thereon, from being crushed. This might otherwise occur if an apparatus with no stoppers was mounted behind a door.

Figure 5:
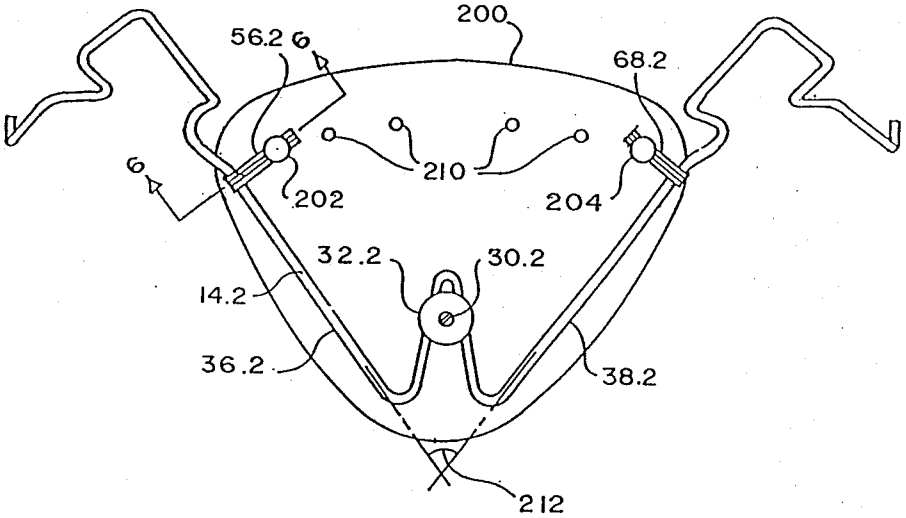
FIG. 5 is a simplified front view of an apparatus for holding a bag according to a second embodiment of the invention.
Figure 7:
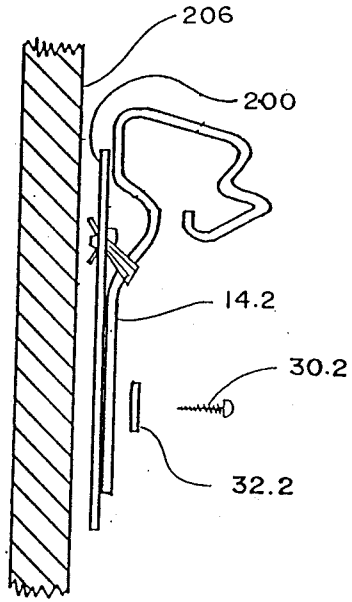
FIG. 7 is a simplified side view of the apparatus of FIG. 5.
Figure 6:
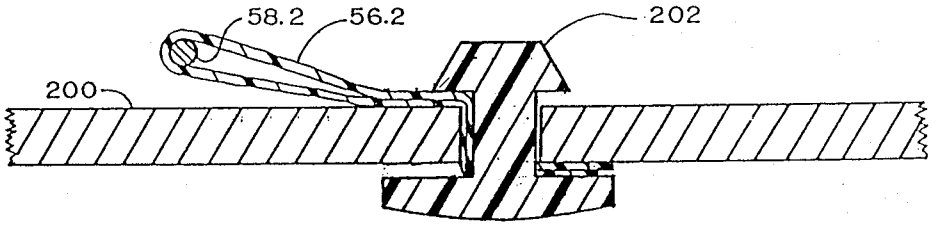
FIG. 6 is a simplified cross-sectional view taken along line 6—6 of FIG. 5.

A second embodiment of the invention is shown in FIGS. 5, 6 and 7. Numerical references corresponding to items already designated in the first embodiment are distinguished by the additional of "0.2". In this embodiment, the bent wire of the preferred embodiment is connected to a back plate 200 using a first screw 30.2 and a first washer 32.2. First and second elastic cords 56.2 and 68.2 are connected by first and second plug bumpers 202 and 204 to the back plate as shown in cross-section in FIG. 6. Referring to FIG. 7, the back plate is secured to a wall 206 by the first screw 30.2 and first washer 32.2 or other such device.

Referring back to FIG. 5, the back plate 200 has a plurality of openings 210 for receiving the first and second plug bumpers 202 and 204. By placing the first and second plug bumpers in different openings, an angle 212 between the third and fourth members 36.2 and 38.2 can be varied to allow the apparatus to accommodate bags of different sizes. The back plate also serves as a splash guard for preventing articles from coming into contact with the wall 206.

Figure 9:
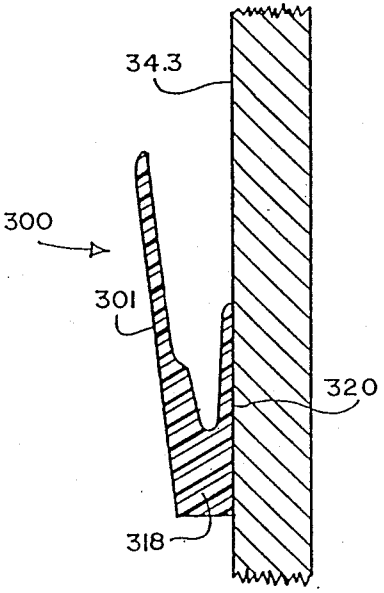
FIG. 9 is a simplified cross-sectional view of the apparatus of FIG. 8 taken along line 9—9 of FIG. 8.
Figure 8:
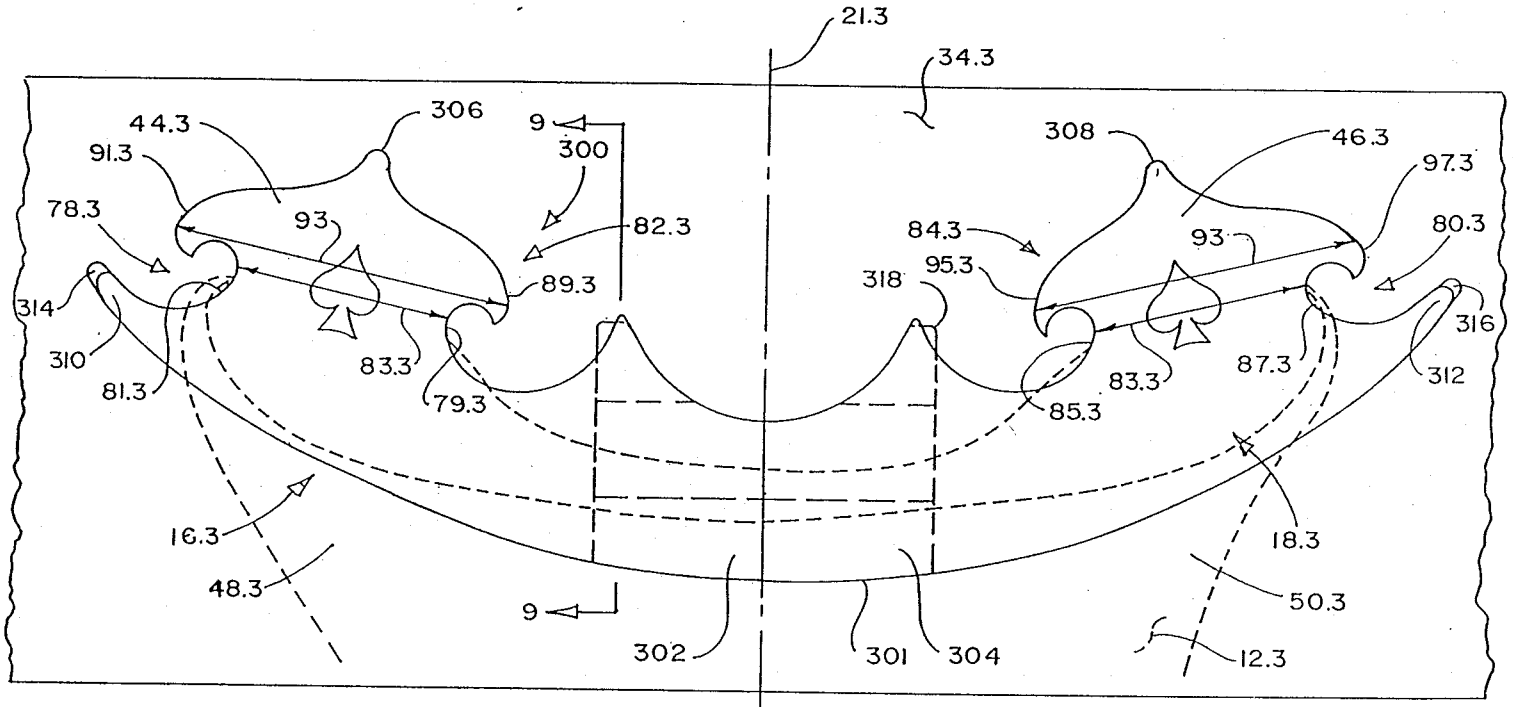
FIG. 8 is a simplified front view of an apparatus for holding a bag according to a third embodiment of the invention, the apparatus being shown secured to a vertical surface and supporting a bag.

Referring now to FIGS. 8 and 9 a third alternative embodiment of the invention is shown. The apparatus of this embodiment is intended for use in automobiles or other areas of limited space. Numerical references corresponding to items already designated in the first embodiment are distinguished by the addition of ".3".

Referring to FIG. 8, an apparatus 300 has a main section 301 which is made of a piece of flexible sheet material such as plastic which provides resilient properties for the operation of the device. The main section 301 has first and second side portions 16.3 and 18.3 which are symmetrical about a vertical axis 21.3. The first and second side portions have first and second inner portions 302 and 304 respectively which are connected to first and second bag holders 44.3 and 46.3 respectively. The first and second inner portions provide first and second means for supporting the bag 12.3. The first and second inner portions also provide first and second resilient portions which resiliently support the first and second portions 48.3 and 50.3 of the bag 12.3. The resilient portions are bendable outwardly from the surface which allows the positions of the first and second bag holders 44.3 and 46.3 to be varied.

The first and second bag holders 44.3 and 46.3 have first and second collar portions 78.3 and 80.3 respectively formed from first and second pairs of opposite facing recesses in the main section 301. Each pair of edges is spaced apart by a first distance 83.3. The first and second collar portions engage the respective first and second portions 48.3 and 50.3 of the bag 12.3 by providing a seat on which the handles or other openings in the first and second portions of the bag may rest.

The collar portions 78.3 and 80.3 are connected to hook-like projections of the main section 301 forming a pair of edges. The spacing between the edges of the hook-like projections is greater than the spacing between the edges of the collar portions thus the hook-like projections form first and second retaining portions 82.3 and 84.3. The retaining portions prevent the first and second portions 48.3 and 50.3 of the bag from slipping off of the collar portions. This is particularly useful when the apparatus is installed on an automobile glove compartment door where the apparatus is required to hold the bag at any position of the door.

Adjacent the retaining portions 82.3 and 84.3, the main section 301 further includes first and second head portions 306 and 308 respectively. The head portions are "arrowhead shaped" and are for passing through openings of handles or through holes in the first and second portions 48.3 and 50.3 of the bag 12.3.

The main section 301 further includes first and second piercing portions 310 and 312 respectively disposed at diametrically opposite outer extremities of the main section, adjacent to the respective first and second bag holders 44.3 and 46.3. The first and second piercing portions have sharpened edges 314 and 316 for piercing support holes as desired in portions of the bag. Thus, a bag originally having no handle openings or supporting holes can have supporting holes pierced in it to permit use with the apparatus.

Referring to FIG. 9, the main member 301 has an anchoring portion 318 which is V-shaaped in cross section to facilitate the storage of maps etc. The anchoring portion has a rear face 320 which has an adhesive backing thereon for connecting the anchoring portion to the surface 34.3.

Figure 10:
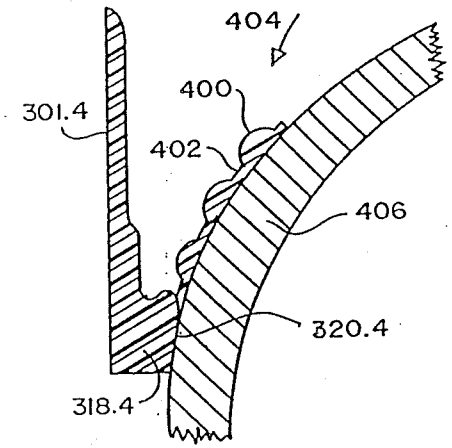
FIG. 10 is a simplified cross-sectional view of an apparatus of a fourth embodiment showing alternate securing means for a curved surface, as would be seen in line 9—9 of FIG. 8.

Referring to FIG. 10, a fourth alternative embodiment of the invention is shown. Numerical references corresponding to items already designated in the first embodiment are distinguished by the addition of ".4." The apparatus of the fourth embodiment is similar to that of the third embodiment except that it includes an anchoring portion 318.4 which can be bent to conform to a curved surface.

The anchoring portion 318.4 has a plurality of parallel elongated, semi-cylindrical shaped portions 400 spaced apart by web portions 402 to form a resilient, bendable portion 404. The resilient bendable portion allows the anchoring device to be bent to conform to a curved surface such as an automobile dashboard 406 and to be secured thereto by an adhesive backing on the portion 404.

Figure 11:
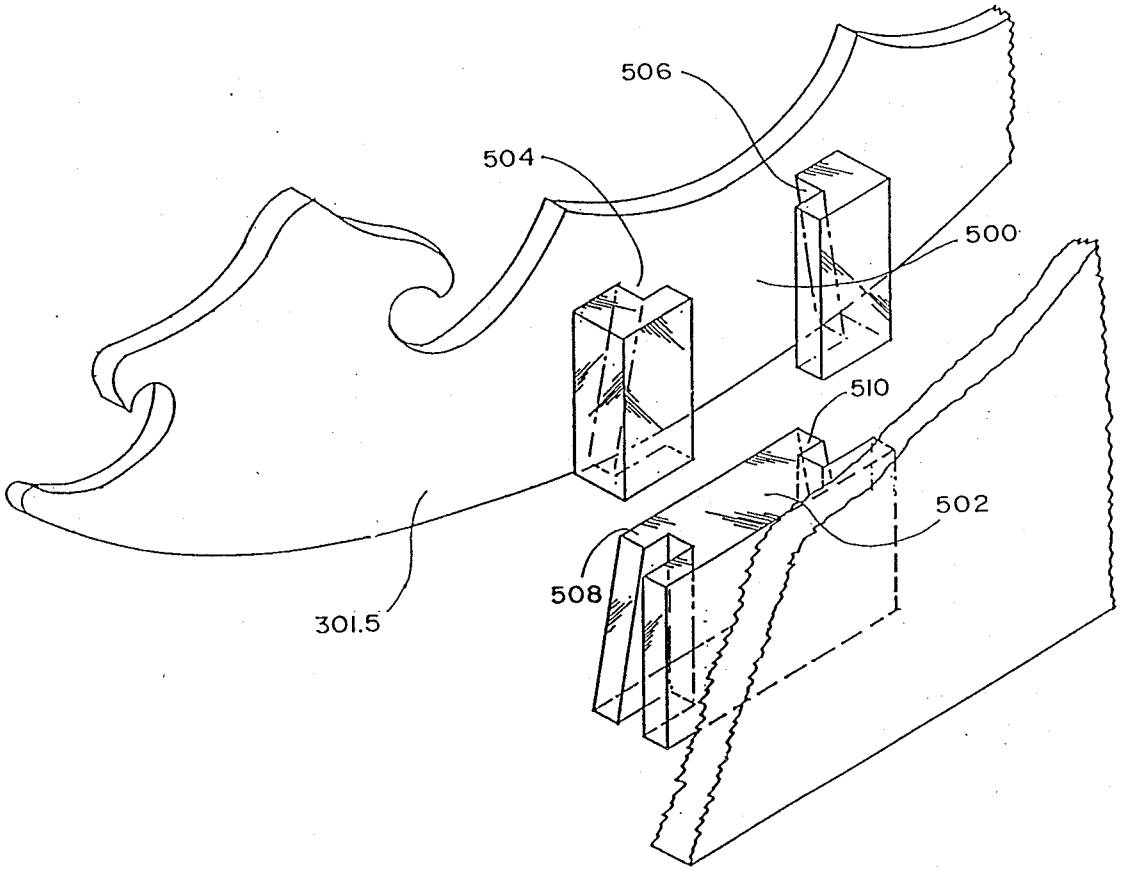
FIG. 11 is a simplified fragmented rear perspective view of an apparatus for holding a bag according to a fifth embodiment of the invention.

Referring to FIG. 11, a fifth embodiment is shown. Numerical references corresponding to items already designated in the first embodiment are distinguished by the addition of ".5". The apparatus of the fifth embodiment is similar to that of the third embodiment except that it includes means for removably connecting the apparatus to the surface.

An apparatus according to the fifth embodiment includes a main member 300.5 having a receptacle 500 for connecting to a hanger 502. The receptacle has first and second tapered channel portions 504 and 506. The hanger has first and second projections 508 and 510 which mate with the first and second channel portions of the receptacle. The main member 300.5 may be removably secured to the wall by placing the receptacle 500 over the hanger and sliding it downward to engage the hanger projections with the receptacle channels. The receptacle and hanger provide means for removably connecting the apparatus to a surface. By having the apparatus removably connectable to the surface, it is well adapted to hold bags in areas where permanent installation is not practical. Such areas may include hospitals and boats.

OPERATION

Referring to FIG. 1, in the preferred embodiment, the apparatus 10 is oriented such that the first and second hook projections 98 and 100 are facing the surface 34. The apparatus is secured to the surface by the first screw and first washer 30 and 32. The third and fourth members 36 and 38 are then bent about resilient portions 40 and 42 to space the first and second bag holders 44 and 46 to accommodate a desired size of bag 12, as determined by spacing between handles of the bag. The third and fourth members may then be fastened to the surface by the second screw 62 and second washer 64 and by third screw and third washer 74 and 76 respectively. The apparatus is thus rendered ready to hold a bag.

The bag 12 is placed onto the apparatus by placing openings in the first and second portions 48 and 50 of the bag onto the collars 78 and 80 of respective bag holders 44 and 46. The angled orientation of the first and second bag holders 44 and 46 holds open the opening 52 of the bag. The bag is therefore ready to receive articles.

As articles are placed into the bag, a downward force due to weight carried by the bag increases and hence force on the bag holders 44 and 46 increases. This increasing force is counteracted by the first and second elastic cords 56 and 68 which allow the first and second supporting means to bend downward but not deform.

Each of the devices described in the alternative embodiments operates in a similar fashion. The flexible sheet device described in the third, fourth and fifth embodiments, however, is slightly less flexible than the wire device of the first and second embodiments.

While specific embodiments of the invention have been described, such embodiments should be considered illustrative of the invention only and not as limiting the scope of the invention as construed in accordance with the accompanying claims.

What is claimed is:

1. An apparatus for holding a bag, the apparatus being securable to a surface, the apparatus comprising:
(a) first and second supporting means for supporting the bag;
(b) first and second bag holders connected to the first and second supporting means respectively, the first and second bag holders being operable to hold first and second portions of the bag;
(c) first and second resilient portions cooperating with the first and second supporting means respectively to resiliently support the first and second portions of the bag to facilitate bending of the first and second supporting means;
(d) first means for fastening the first and second supporting means to the surface;
(e) first and second elastic links extending from the first and second supporting means respectively, and second and third fastening means cooperating with the first and second elastic links respectively to fasten the links to the surface.

2. An apparatus as claimed in claim 1, wherein:
(a) the first means for fastening includes a fastening portion for receiving a fastener, the fastening portion being between the first and second supporting means.

3. An apparatus as claimed in claim 1, further including first and second stoppers connected to the first and second bag holders, the first and second stoppers being positioned to contact the surface to prevent the first and second bag holders from lying flat against the surface.

4. An apparatus as claimed in claim 3 wherein the first and second stoppers have first and second hook portions respectively.

5. An apparatus as claimed in claim 1, wherein the first and second bag holders include first and second collar portions respectively for engaging respective first and second portions of the bag.

6. An apparatus as claimed in claim 5, wherein the first and second bag holders include first and second retaining portions for retaining the respective first and second portions of the bag on respective first and second collar portions, the first and second retaining portions being adjacent respective first and second collar portions.

7. An apparatus as claimed in claim 6 wherein the first and second collar portions each include a respective pair of edges spaced apart by a first distance and the first and second retaining portions each include a respective pair of edges spaced apart by a second distance, the second distance being greater than the first distance.

8. An apparatus as claimed in claim 1 wherein the second and third means for fastening include an annular washer having a lip for crimping the elastic link against the surface.

9. An apparatus for holding a bag, the apparatus being securable to a surface, the apparatus comprising:
(a) a length of wire having;
(i) first means for fastening the apparatus to the surface, the first means including first and second portions of the wire, the first and second portions being connected together by a first bend;
(ii) first and second resilient portions formed from second and third bends respectively in the wire, the second and third bends being connected to the first and second portions respectively;
(iii) first and second supporting means for supporting the bag, the first and second supporting means being formed from third and fourth portions of the wire, and third and fourth portions being connected to the second and third bends respectively;
(iv) first and second bag holders having first and second collar portions respectively and first and second retaining portions respectively, the first and second collar portions being formed from first and second pairs of bends in the wire respectively, each pair of bends including a first bend and a second bend spaced apart by a first distance, the first bend of the first pair being connected to the first portion of the wire and the first bend of the second pair being connected to the fourth portion of the wire, the first and second retaining portions being formed from third and fourth pairs of bends respectively, each pair of bends including a first bend and a second bend spaced apart by a second distance, the second distance being greater than the first distance, the first bend of the third pair being connected to the first bend of the first collar portion and the first bend of the fourth pair being connected to the first bend of the second collar portion, the second bend of the third pair being connected to the second bend of the first pair and the second bend of the fourth pair being connected to the second bend of the second pair;
(v) first and second stopping means for stopping the apparatus from being crushed, the first and second stopping means being formed from fifth and sixth portions of the wire respectively the fifth portion of the wire being connected to the second bend of the first pair of bends and the sixth portions of the wire being connected to the second bend of the second pair of bends, the first and second stopping means being operable to prevent the first and second bag holders from lying flat against the surface;
(vi) first and second hook portions connected to the fifth and sixth portions respectively, the first and second hook portions each being operable to pierce a hole in the bag;
(b) second and third means for fastening the first and second supporting means respectively to the surface, the second and third means including respectively elastic links connected to respective supporting means, the elastic links being connected to the surface by respective fasteners, the fasteners including an annular washer, the annular washing having a lip for crimping the elastic link to the surface.

10. An apparatus for holding a bag, the apparatus being securable to a surface and comprising:
(a) a length of relatively stiff wire having:
(i) first and second supporting means having first and second resilient portions adjacent inner portions of the supporting means to facilitate limited bending of the supporting means when under load,
(ii) first and second bag holders adjacent outer portions of the first and second support means to hold first and second portions of the bag respectively, the first and second bag holders having respective first and second collar portions and first and second retaining portions, the first and second collar portions being formed from first and second pairs of bends in the wire respectively, each pair of bends including a first bend and a second bend spaced apart by a first distance, and the first and second retaining portions being formed from third and fourth pairs of bends respectively, each pair of bends including a first bend and a second bend spaced apart by a second distance, the second distance being greater than the first distance, the bends of the collar portions being connected to the bends of an adjacent retaining portion, a portion of wire interconnecting the bends of the adjacent retaining portion and forming a head portion disposed between the adjacent retaining portions for passing easily through portions of bag so that a portion of the bag engaged by a particular collar portion is retained by an adjacent retaining portion, (b) a black plate securable to the surface, the back plate being generally adjacent and parallel to the supporting means and having an opening, (c) a first means for fastening the wire to the back plate, the first means cooperating with the opening of the back plate and being connected to the inner portions of the supporting means so that the supporting means extend outwardly therefrom.

11. An apparatus as claimed in claim 10, in which:

(a) the back plate includes second and third openings therein, and the apparatus further includes:

(b) second and third means for fastening the first and second supporting means respectively to the back plate, the second and third means including respective elastic links connected to the respective supporting means, and connected by respective fasteners which cooperate with the second and third openings in the back plate, so as to augment support of the supporting means.

12. An apparatus as claimed in claim 10, further including:

(a) first and second stopping means for stopping the apparatus from excessive deflection, the first and second stopping means being connected to the first and second bag holders and being positioned to contact the surface to prevent the bag holders from lying flat against the surface.

13. An apparatus for holding a bag, the apparatus being securable to a surface and comprising:

(a) an elongated, integral, flexible sheet main section being generally flat and disposed within a plane parallel to the surface when unloaded, the main section having:

(i) first and second supporting means having first and second resilient portions adjacent inner portions of the supporting means to facilitate limited bending of the supporting means when under load, (ii) first and second bag holders adjacent outer portions of the first and second support means to hold first and second portions of the bag respectively, the first and second bag holders having respective first and second collar portions and first and second retaining portions, the collar portions each having a pair of edges spaced apart by a first distance to define a pair of oppositely facing recesses, and the retaining portions each including a respective head portion having a respective pair of edges spaced apart by a second distance, each head portion being arrowhead-shaped so as to extend away from a respective collar portion and to facilitate passing through openings in the respective portions of the bag, the second distance being greater than the first distance so that a portion of the bag passing around the respective collar portion is retained thereon by the head portion, irrespective of the orientation of the apparatus, the edges of the collar portions and the retaining portions being generally within the said plane when unloaded; and (b) an anchoring means for anchoring the main section of the apparatus to the surface, the anchoring means being connected to the inner portions of the supporting means so that the supporting means extend outwardly therefrom.

14. An apparatus as claimed in claim 13 wherein the anchoring means includes a bendable portion for shaping said anchoring means to a curved surface.

15. An apparatus as claimed in claim 13, further including first means for removably connecting the apparatus to the surface.

16. An apparatus as claimed in claim 15 wherein the means for removably connecting includes a hanger and a mating receptacle, the hanger being securable to the surface and having first and second projections extending therefrom, the receptacle being on the apparatus and having first and second channels for removably receiving the first and second projections of the hanger respectively.

17. An apparatus for holding a bag, the apparatus being securable to a surface and comprising:

(a) an elongated, integral, flexible sheet main section being generally flat and disposed within a plane parallel to the surface when unloaded, the main section having:

(i) first and second supporting means having first and second resilient portions adjacent inner portions of the supporting means to facilitate limited bending of the supporting means when under load, (ii) first and second bag holders adjacent outer portions of the first and second support means to hold first and second portions of the bag respectively, the first and second bag holders having respective first and second collar portions and first and second retaining portions, the collar portions each having a pair of edges spaced apart by a first distance to define a pair of oppositely facing recesses, and the retaining portions each including a respective head portion having a respective pair of edges spaced apart by a second distance, the second distance being greater than the first distance so that a portion of the bag passing around the respective collar portion is retained thereon by the head portion, irrespective of the orientation of the apparatus, the edges of the collar portions and the retaining portions being generally within the said plane when unloaded, (b) an anchoring means for anchoring the main section of the apparatus to the surface, the anchoring means being connected to the inner portions of the supporting means so that the supporting means extend outwardly therefrom;

(c) piercing means for piercing holes in the bag, the piercing means being adjacent the outer portions of the support means.

18. An apparatus as claimed in claim 17 in which:

(a) the piercing means have sharpened edges.

* * * * *